United States Patent [19]

Lim et al.

[11] Patent Number: 4,790,540

[45] Date of Patent: Dec. 13, 1988

[54] DISPLAY TRAY AND BOARD GAME SUPPORT

[75] Inventors: Edmond H. Lim; Delores S. Middleton, both of El Cerrito, Calif.

[73] Assignee: Limardee Enterprises, Ltd., El Cerrito, Calif.

[21] Appl. No.: 75,155

[22] Filed: Jul. 20, 1987

Related U.S. Application Data

[63] Continuation-in-part of Ser. No. 49,077, May 12, 1977.

[51] Int. Cl.[4] ..... A63F 1/00; A63F 9/00

[52] U.S. Cl. ..... 273/309; 40/124.2; 273/150

[58] Field of Search ..... 273/148 A, 150, 309; 40/124.2

[56] References Cited

U.S. PATENT DOCUMENTS

| | | | |
|---|---|---|---|
| 619,960 | 2/1899 | Hustedt | 273/150 |
| 3,791,651 | 2/1974 | Barnum et al. | 273/150 |
| 4,227,698 | 10/1980 | Ishizuki | 273/150 X |

*Primary Examiner*—Anton O. Oechsle

*Attorney, Agent, or Firm*—Townsend and Townsend

[57] ABSTRACT

A display tray and board game support includes four display trays supported at a display angle to the horizontal by tray supports. The display trays each have a number of parallel, offset pockets sized to hold sheet-like playing elements such as play money and decision cards used in the play of the game. The tray supports are L-shaped members which engage the ends of adjacent display trays to both support and properly position the display trays. The display trays each have a horizontal game board support ledge positioned along the upper edge. The trays and tray supports are sized so that the game board is supported on the support ledges. An upwardly extending lip at the upper edge of the display tray acts as an outer barrier for the game support resting on the game support ledge. When the display tray is made of two parts, to facilitate manufacture, the two parts can be connected by pin and socket elements and can include abutment members to resist flexing or bending of the display tray elements relative to one another.

18 Claims, 3 Drawing Sheets

DISPLAY TRAY AND BOARD GAME SUPPORT

This is a continuation-in-part of U.S. Design patent application Ser. No. 049,077, filed May 12, 1987, and entitled BOARD GAME SUPPORT.

BACKGROUND OF THE INVENTION

Board games remain very popular among a great number of people. Many board games involve the use of play paper money, various decisional cards which are used in the play of the game and cards evidencing ownership, such as the deeds used with Monopoly brand board games. One of the problems associated with board games is how to keep all the money of various denominations and cards used during the play of the game neatly ordered. Although various strategies are used, none has found to be really satisfactory as providing both proper display and easy access.

SUMMARY OF THE INVENTION

The present invention is directed to a display tray and board game support used with board games having sheet-like playing elements such as cards and paper money to properly segregate and display the sheet-like playing elements.

The display tray and board game support includes a display tray supported on a playing surface at a display angle to the horizontal by a tray support. The display tray has a number of parallel, offset support surfaces which face the user at the display angle. The lower portions of the support surfaces have barrier panels positioned above them to define pockets. The pockets are sized to hold sheet-like playing elements such as play money and decision cards used in the play of the game. The pockets are offset from one another as one moves from the upper edge to the lower edge of the display tray so that the various sheet-like playing elements in different pockets can be viewed with minimal obstruction.

The display tray also preferably has a horizontally extending game board support ledge positioned along the upper edge. An upwardly extending lip at the upper edge of the display tray acts as an outer barrier for the game board resting on the game board support ledge.

The tray support preferably engages a slot or other opening along the upper edge of the display tray. The support can be an L-shaped member to engage the support openings in two adjacent display trays so to both support the display trays and interlock them. This allows the user to securely position a display tray along each edge of the game board to circumscribe and support the game board.

The display tray can be made of two parts, if desired, to facilitate manufacture. The two parts can be connected by pin and socket elements and preferably include abutment members to resist flexing or bending of the display tray elements relative to one another.

One of the primary advantages of the invention is that it neatly arranges and segregates various denominations of money, different types of playing cards and so forth for the player while keeping them at an appropriate display angle. When display trays act as game board supports, the game board is elevated to the upper edge of the display tray so that the game board is not obscured by the angled display trays.

The pockets of the display tray are preferably of different depths to accommodate sheet-like playing elements of different thicknesses. The upper edges of the barrier panels can be tapered or angled to aid inserting the sheet-like playing element into the pocket. This is quite useful when the playing element is relatively flimsy, such as paper money.

Other features and advantages of the invention will appear from the following description in which the preferred embodiments have been set forth in detail in conjunction with the accompanying drawings.

DETAILED DESCRIPTION OF THE PREFERRED EMBODIMENTS

Figure 1:
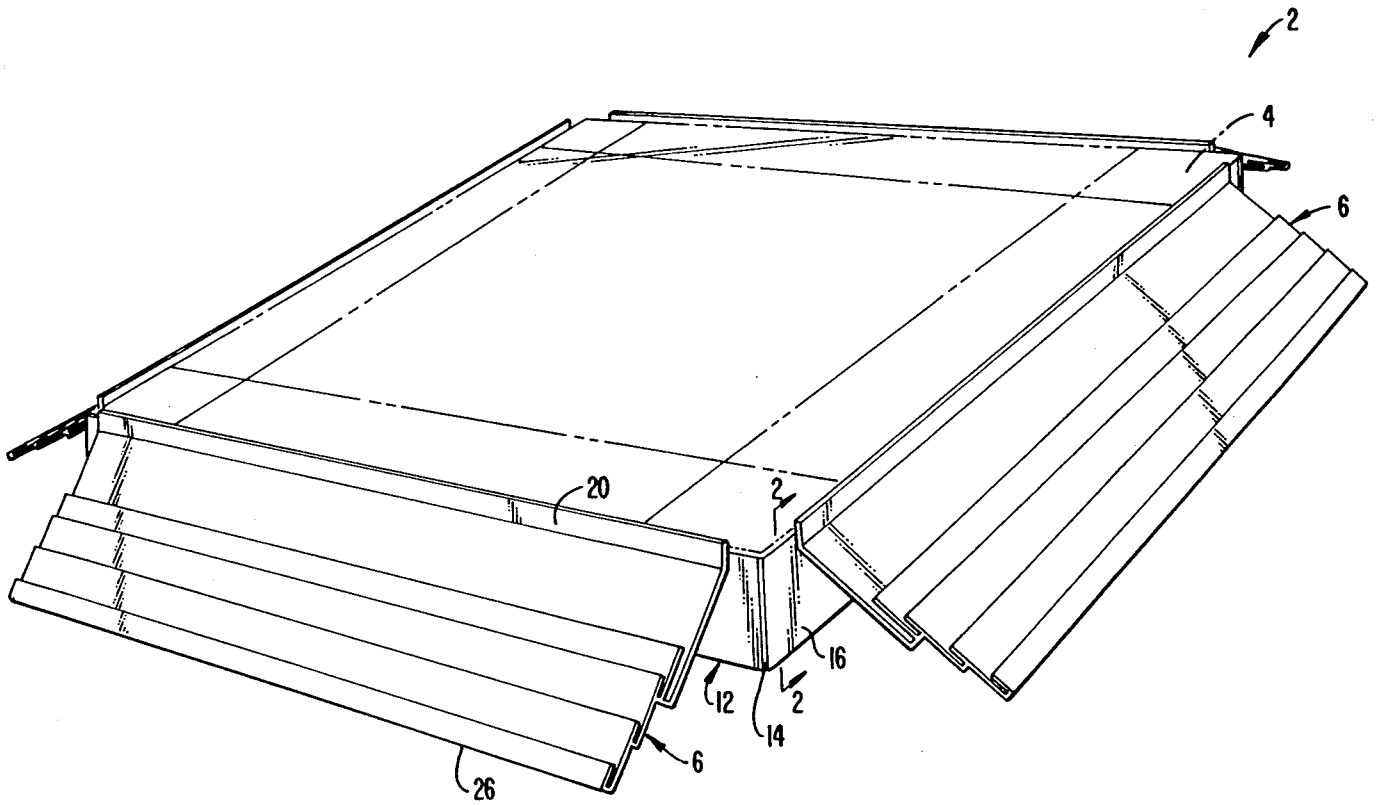
FIG. 1 is a perspective view of the display tray and game board support assembly of the invention supporting a game board.

Referring now to FIG. 1, a display tray and game board support assembly 2 is shown used with a four sided game board 4. Assembly 2 includes a display tray 6, supported at a display angle 8 (see FIG. 2) relative to a horizontal playing surface 10 by an L-shaped tray support 12 at each end. Support 12 is, in the preferred embodiment, flexible at hinged corner 14 so that legs 16 of support 12 can be oriented at almost any angle relative to one another.

Display tray 6 includes an elongate slot 18 (see FIG. 3) along the upper edge 20 of display tray 6 and within which upper notched portions 22 of supports 12 fit. Display tray 6 also includes horizontally extending game board support ledge 24 along upper edge 20 extending away from the lower edge 26 of display tray 6 and upon which game board 4 rests. A lip 28 extends upwardly from ledge 24 to act as a barrier to limit lateral movement of game board 4.

Figure 2:
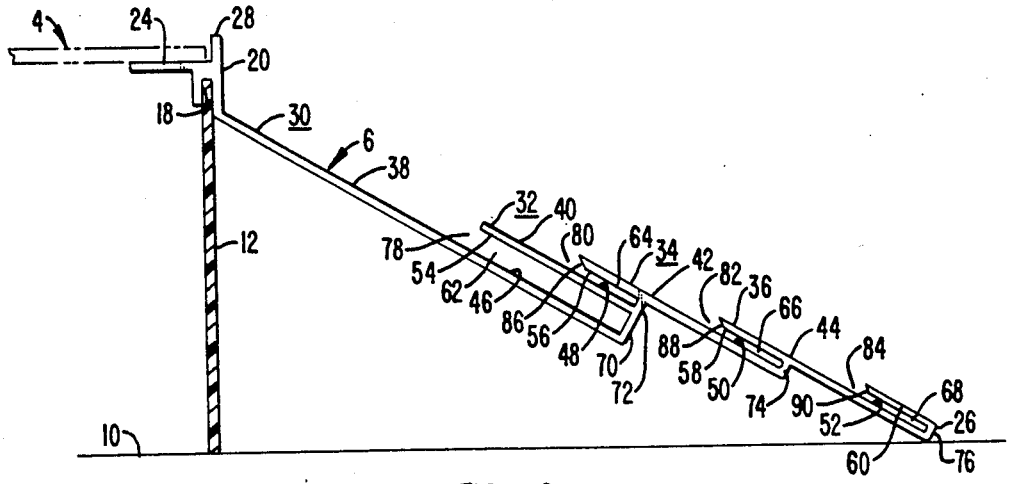
FIG. 2 is a view taken along line 2—2 of FIG. 1.
Figure 2A:
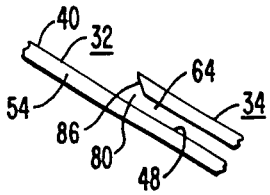
FIG. 2A is an enlarged view of the upper edge of a barrier panel and the underlying support surface.
Figure 3:
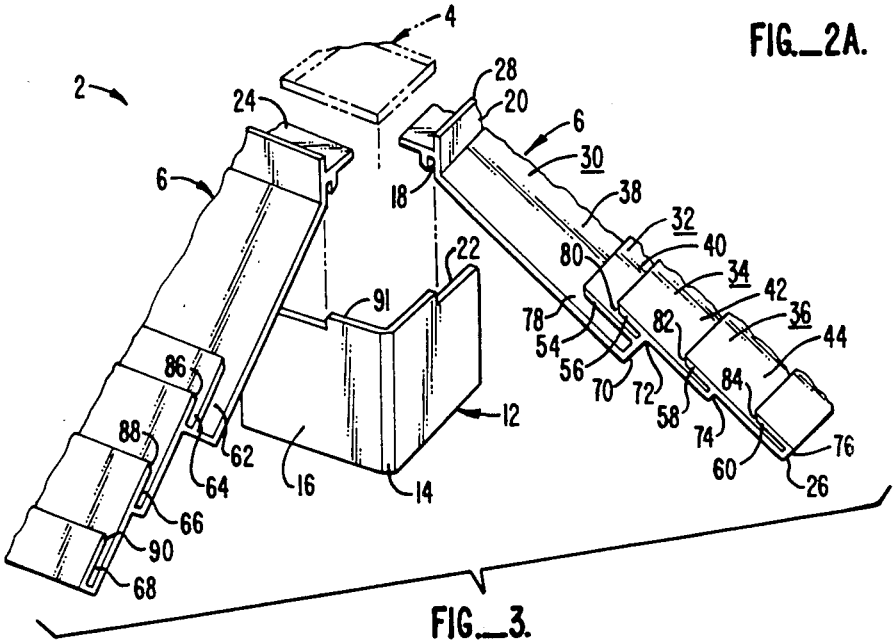
FIG. 3 is an exploded isometric view of a corner of the assembly of FIG. 1.

Display 6 see FIGS. 2, 2A and 3, includes a number of parallel, vertically and horizontally offset support surfaces 30, 32, 34, and 36. Each of support surfaces 30–36 includes an upper portion 38, 40, 42, and 44 and a lower portion 46 48, 50, and 52. Barrier panels 54, 56, 58, and 60 overlie lower portions 46–52 to define pockets 62, 64, 66, and 68 therebetween. Pockets 62–68 are defined at their lower and upper ends by a closed bottom 70, 72, 74, and 76 and open top 78, 80, 82, and 84. In the preferred embodiment all pockets 62–68 are the same width while pocket 62 is deeper and taller than pockets 64, 66, and 68. This is done so pocket 62 accommodates thicker sheet-like playing elements, such as deeds used when playing the Monopoly brand board game, while pockets 64, 66, and 68 are narrower to accommodate thinner, sheet-like playing elements, such as play money. The upper edges 86, 88, and 90 of barrier panels 56, 58, and 60, seen best in FIG. 2A, are tapered or beveled to permit the easy insertion of sheet-like playing elements into pockets 64, 66, and 68.

Figure 4:
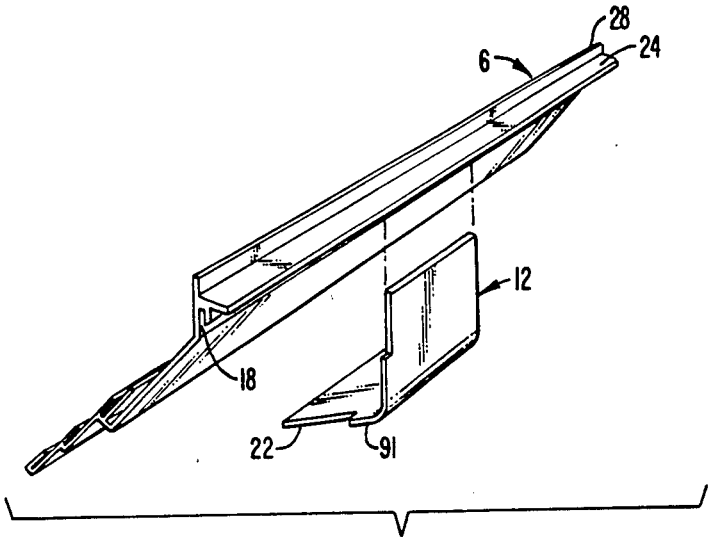
FIG. 4 is a perspective view of a display tray of FIG. 1 showing a single support being mounted to the center of the display tray for stand-alone use.

As shown in FIG. 4, the display tray 6 can be used as a stand-alone unit with a support 12 mounted centrally along slot 18. Support 12 can be used in the L-shaped configuration shown or it can be extended so legs 16 form a 180 degree angle (not shown) with the central portion 91 of support 12 inserted into slot 18.

Figure 5:
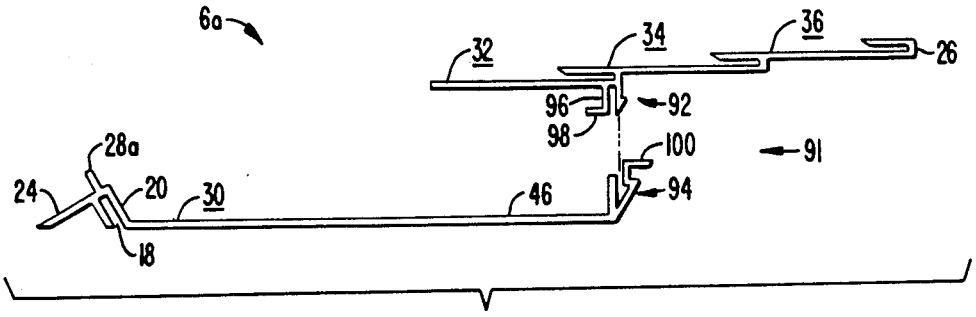
FIG. 5 is an edge view of an alternative embodiment of the display tray of FIG. 1.

At FIG. 5, an alternative embodiment of display tray 6 is shown. Display tray 6a is similar to display tray 6 but has lip 28a set back so to be aligned with slot 18. Also, closed bottom 70 of display tray 6 is replaced by a joint 91 including pin and socket elements 92, 94. Pin element 92 includes an abutment member 96 having a surface 98 which lies adjacent lower portion 46 of support surface 30 when pin and socket elements 92, 94 are engaged. In addition, socket element 94 includes an abutment member 100 which likewise abuts the surface 102 of display tray 6 opposite support surface 34. Abutment members 96, 100 act to prevent or substantially reduce bending of display tray 6A at joint 91. It has been found that, depending upon the size of display tray 6, when making display tray 6 as an extrusion it is much preferred from a manufacturing standpoint to form display tray 6 in two pieces.

In use, assuming four display trays 6 are being used with a square game board 4, four supports 12 are mounted within the adjacent slots 18 of adjacent display trays 6 as shown in FIG. 3. Once this is accomplished at all four corners, game board 4 can be placed on support ledges 24 and the play can proceed. If desired, display trays 6 can be used as free-standing elements as shown in FIG. 4.

Modifications and variations can be made to the disclosed embodiments without departing from the subject of the invention as defined in the following claims. For example a greater or lesser number of pockets 62–68 can be formed, the pockets having a different mix of sizes as well.

What is claimed is:

1. A display tray assembly for use with board games of the type using sheet-like play elements comprising:

a display tray having first and second edges;

a tray support mounted to the display tray for supporting the display tray at a display angle to the horizontal with the first edge raised relative to the second edge;

the display tray having a plurality of support surfaces in planes offset from one another, the support surfaces having upper and lower portions; and the display tray including barrier panels overlying and spaced apart from the lower portions of the support surfaces to define pockets for receipt of the sheet-like playing elements, the pockets being of different sizes to accommodate different sizes of the sheet-like playing elements.

2. The assembly of claim 1 wherein the display tray includes a downwardly directed opening and the tray support includes a portion sized to mate with the opening to secure the display tray to the tray support.

3. The assembly of claim 2 wherein the opening is positioned along the first edge.

4. The assembly of claim 1 wherein the support is L-shaped.

5. The assembly of claim 1 wherein the support surfaces define parallel planes.

6. The assembly of claim 1 wherein the display tray includes a game board support ledge at the first edge whereby a plurality of said assemblies can be used to support a game board.

7. The assembly of claim 1 wherein the barrier panels have upper edges defining openings into said pockets, the upper edges angled to aid insertion of the sheet-like playing elements into the pockets.

8. The assembly of claim 1 wherein the display tray includes upper and lower elements joined by a locking element.

9. The assembly of claim 8 wherein the locking element is a pin and socket arrangement.

10. The assembly of claim 8 wherein the locking element includes a pin element extending from a chosen one of the upper and lower elements and a socket element at the other of the upper and lower elements.

11. The assembly of claim 10 further comprising a first abutment member extending from the socket element to abut the chosen one of the upper and lower elements so to help prevent relative flexing of the upper and lower elements.

12. The assembly of claim 8 wherein the locking element includes means for inhibiting relative flexing of the upper and lower elements.

13. A display tray and board game support assembly for use with a board game of the type having a polygonal game board and sheet-like playing elements comprising:

display trays each having first and second edges and a downwardly opening slot along the first edge;

a corner tray support mounted to the to the extremities of each opening in each of the display trays for supporting the display trays at a display angle to the horizontal with the first edge raised relative to the second edge the corner tray supports coupling the display trays end to end in the shape of the polygonal game board;

the display trays each having a plurality of support surfaces in planes offset from one another, the support surfaces having upper and lower portions;

the display trays each including barrier panels overlying and spaced apart from the lower portions of the support surfaces to define pockets for receipt of the sheet-like playing elements;

the display trays each including a game board support ledge at the first edge for supporting the polygonal game board; and any upwardly extending lip at the first edge between the support surfaces and the game board support ledge of each display tray to position the game board on the support ledges.

14. A display tray assembly for use with board games of the type using sheet-like play elements comprising:

a display tray having first and second edges;

a tray support mounted to the display tray for supporting the display tray at a display angle to the horizontal with the first edge raised relative to the second edge;

the display tray including a game board support ledge at the first edge whereby a plurality of said assemblies can be used to support a game board;

the display tray having a plurality of support surfaces in planes offset from one another, the support surfaces having upper and lower portions; and the display tray including barrier panels overlying and spaced apart from the lower portions of the support surfaces to define pockets for receipt of the sheet-like playing elements.

15. The assembly of claim 14 wherein the game board support ledge is generally horizontal when said display tray is supported at said display angle.

16. The assembly of claim 14 wherein the display tray includes an upwardly extending lip at the first edge between the support surfaces and the game board support ledge.

17. A display tray assembly for use with board games of the type using sheet-like play elements comprising:

a display tray having first and second edges;

a tray support mounted to the display tray for supporting the display tray at a display angle to the horizontal with the first edge raised relative to the second edge;

the display tray having a plurality of support surfaces in planes offset from one another, the support surfaces having upper and lower portions;

the display tray including barrier panels overlying and spaced apart from the lower portions of the support surfaces to define pockets for receipt of the sheet-like playing elements;

the display tray including upper and lower elements joined by a locking element, the locking element including a pin element extending from a chosen one of the upper and lower elements and a socket element at the other of the upper and lower elements; and a first abutment member extending from the socket element to abut the chosen one of the upper and lower elements so to help prevent relative flexing of the upper and lower elements.

18. The assembly of claim 17 further comprising a second abutment member extending from a position adjacent the pin element to abut the other of the upper and lower elements so to help prevent relative flexing of the upper and lower elements.

* * * * *